US006838116B2

(12) United States Patent
Liu et al.

(10) Patent No.: US 6,838,116 B2
(45) Date of Patent: Jan. 4, 2005

(54) OXYGEN-REMOVING PRE-PROCESS FOR COPPER INTERCONNECT GROWN BY ELECTROCHEMICAL DISPLACEMENT DEPOSITION

(75) Inventors: Don-Gey Liu, Taichung (TW); Tsong-Jen Yang, Taichung (TW), twx; Chin-Hao Yang, Taipei (TW); Wen Luh Yang, Taichung (TW); Giin-Shan Chen, Taichung (TW)

(73) Assignee: Feng Chia University, Taichung (TW)

( * ) Notice: Subject to any disclaimer, the term of this patent is extended or adjusted under 35 U.S.C. 154(b) by 0 days.

(21) Appl. No.: 10/716,550

(22) Filed: Nov. 20, 2003

(65) Prior Publication Data

US 2004/0108221 A1 Jun. 10, 2004

(30) Foreign Application Priority Data

Nov. 22, 2002 (TW) ..... 91134027 A

(51) Int. Cl.[7] ..... B05D 5/12; C25D 5/54

(52) U.S. Cl. ..... 427/96; 427/123; 205/85; 204/192.15

(58) Field of Search ..... 204/192.15; 427/96, 427/561, 564, 565, 591, 123; 205/85, 95

(56) References Cited

U.S. PATENT DOCUMENTS

| | | | | |
|---|---|---|---|---|
| 4,083,754 A | * | 4/1978 | Outsuka et al. | 205/775 |
| 4,725,339 A | * | 2/1988 | Bindra et al. | 205/81 |
| 6,582,580 B1 | * | 6/2003 | Hongo et al. | 205/118 |

FOREIGN PATENT DOCUMENTS

| | | | |
|---|---|---|---|
| JP | 200084 | * | 7/1999 |
| JP | 115076 | * | 4/2002 |
| WO | 10104 | * | 4/1996 |

* cited by examiner

*Primary Examiner*—Brian K. Talbot
(74) *Attorney, Agent, or Firm*—Rosenberg, Klein & Lee

(57) ABSTRACT

A solvent, such as deionized water, is heated up to boil to remove the oxygen dissolved in the water before preparing the plating solutions for the growth of copper interconnects. The resistance of the copper grown from the EDD solutions having undergone the oxygen-removing process is greatly improved, down to a value very close to copper's ideal value.

9 Claims, 3 Drawing Sheets

OXYGEN-REMOVING PRE-PROCESS FOR COPPER INTERCONNECT GROWN BY ELECTROCHEMICAL DISPLACEMENT DEPOSITION

BACKGROUND OF THE INVENTION

1. Field of the Invention

The present invention relates to a pre-process which expels the oxygen in the deionized water, DI water, before preparing the displacement plating solution for copper interconnects grown by displacement reaction, and more particularly by electrochemical displacement deposition (EDD).

2. Description of Related Art

There have been many methods of growing copper films or interconnects for circuits of very large scale integration (VSLI) and ultra large scale integration (ULSI). They can be classified into physical vapor deposition (PVD), chemical vapor deposition (CVD), electroplating, and electroless deposition, etc. However, there are several disadvantages found in these methods. In the case of PVD, the stop coverage of the copper grown in the grooves on the surface of the wafer is not even. The copper film grown by CVD can be conformal while it contains too many impurities such that it has a very high resistance. Furthermore, the popular dry etching process cannot be adopted to remove the unwanted copper due to the corresponding product is non-volatile and is not easily exhausted out of the wafer. Currently, the Damascene process and its variations are predominantly used to form copper wires for modern integrated circuits (ICs).

The Damascene process utilizes the chemical-mechanical polish (CMP) process to remove the unwanted portion of copper. However, the process steps are complicate and the throughput is low. Some researchers proposed low-cost the methods such as electroplating and electroless deposition to increase the throughput. However, there was a concern about the plating agents which will pollute the products and the environment. And the obtained resistance, the step coverage and the quality of the grown copper still need to be improved.

The electrochemical displacement deposition (EDD) has been proposed recently to grow copper with a solution containing popular chemicals used in IC fabrication processes. The EDD process is utilized as a pre-process to create a seed layer for later growth of thick copper layers by the electroplating method or the electroless deposition. However, the copper grown by the method of the EDD also has a high resistance and is difficult to adhere on the surface of the wafer. An annealing process is usually used to reduce the resistance of the copper film.

The present invention has arisen to mitigate and/or obviate the possibility of high resistance for the copper obtained in the chemical plating method, especially the EDD method.

SUMMARY OF THE INVENTION

The main objective of the present invention is to provide an oxygen-removing pre-process for copper grown from "cleaned" chemical solutions to reduce the resistance of the copper. Before preparing the chemical reaction, the DI water is first heated to boil to reduce the concentration of the oxygen in it. The oxygen-removed DI water is then cooled down to the room temperature in a sealed beaker. The electrochemical displacement solution is prepared in the "cleaned" water for later deposition of copper films. It has been found that the obtained copper has a lower resistance than that grown from the same solution without the oxygen-removing preprocess.

Detailed drawings and description about the treatment are shown and described below.

DETAILED DESCRIPTION OF THE INVENTION

Figure 1:
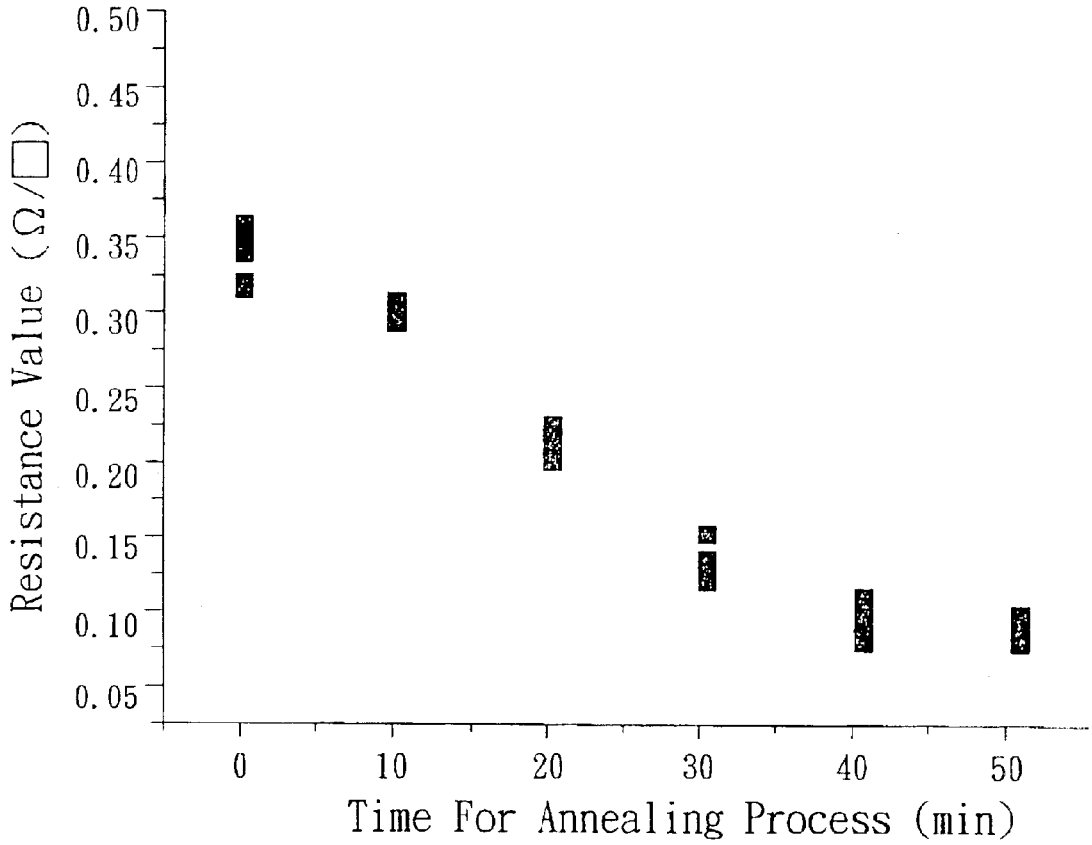
FIG. 1 shows the effect of the annealing time on the sheet resistance of the copper film grown by the electrochemical displacement reaction without oxygen-removing preprocess, wherein the environment gas during annealing is $H_2$ and the annealing temperature is kept at 500 degrees centigrade; a long time, almost up to an hour, of high-temperature process is usually needed to improve the resistance of the copper made from the chemical reactions in electroplating or electroless processes.

High temperature annealing is a practice usually used in semiconductor processes to improve the quality of films. As seen in FIG. 1, it is really effective to introduce hydrogen into the chemically grown copper films in a high-temperature furnace. The cost is time and thermal energy. In FIG. 1, the resistance of copper film is gradually reduced long with the annealing time. It is conjectured that the primary reason to degrade the resistance of the copper film grown by chemical processes may be the oxygen in the solution. The oxygen can be absorbed in the newly formed copper films during the chemical reaction. After annealing in $H_2$, the absorbed oxygen in the copper may react with $H_2$ at high temperatures to become water vapor and be exhausted out of the copper. As a result, the quality of the as-deposited copper films can be further improved by annealing.

Figure 2:
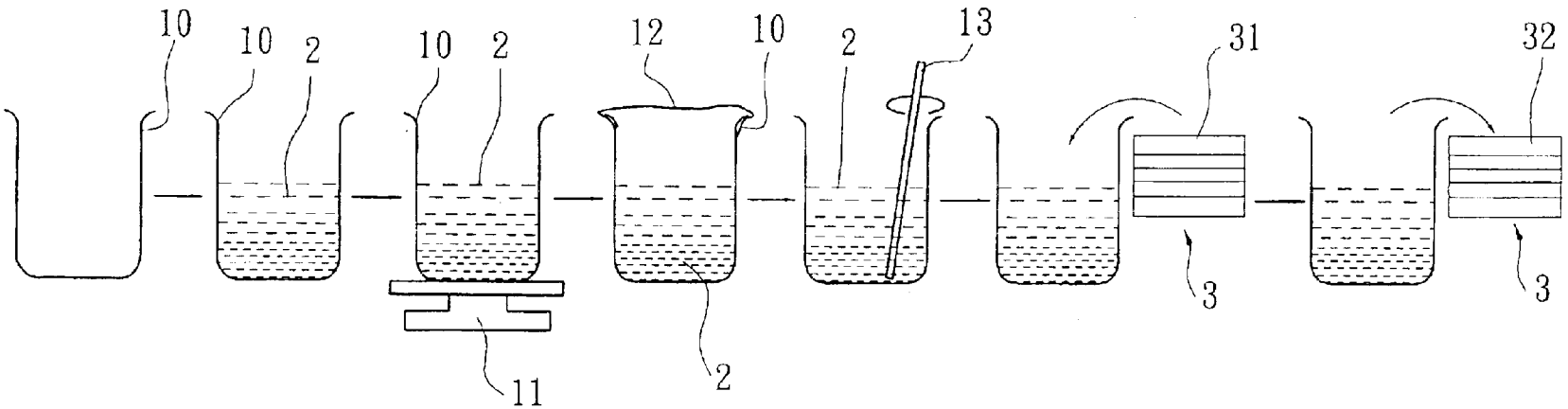
FIG. 2 shows the process flow of the oxygen-removing pre-process before preparing chemical solutions for copper deposition in the present invention.

In this current invention, high-temperature annealing can be omitted if the oxygen-removing preprocess is applied before preparing reaction solutions. FIG. 2 shows one example for the corresponding steps of the EDD method:

Step 1. Prepare a clean Teflon beaker (10).

Step 2. Pour one-liter deionized water (2) into the beaker (10). The deionized water is used as the solvent.

Step 3. The deionized water (2) in the beaker (10) is heated by a heater (11) until boiling and is kept in boiling for two minutes. During the heating process, the beaker (10) is kept open for the oxygen easily going out of the water.

Step 4. Take the beaker (10) off from the heater (11) for cooling. At this moment, the beaker (10) is sealed by a polypropylene film to prevent the oxygen in the air being dissolved back into the water. The beaker (10) is placed in a hood for about forty minutes to cool down to the room temperature.

Step 5. Remove the polypropyelne film and prepare the reaction solution. The solution for EDD method consists of forty-milliliter buffered hydrofluoric (BHF)

acid (or sometimes called buffered oxide etchant, BOE) and four-gram cupric sulphate ($CuSO_4$). The agents in the beaker (10) is well mixed by stirring by a Teflon stick (13).

Step 6. Perform the EDD reaction. A wafer (3) with a titanium layer (31), patterned or blanket, is placed into the solution in the beaker (10) for eight minutes. A newly formed copper film (32) will take the place of the titanium (31).

Step 7. Clean and dry. Take out the wafer (3) where a high quality copper film (32) forms on the surface of the wafer (3).

The following steps give an example to manufacture the wafer (3) before be put into the EDD solution.

Step 1. Prepare a Si wafer of electronic grade.

Step 2. Grow a wet oxide layer of 1500 Å thick to isolate the upper conductor layers from the lower substrate.

Step 3. Grow another thin insulating layer to resist the attacks of HF during in the chemical reaction. This layer can be selected as $Si_3N_4$ having a thickness of 500 Å grown by PECVD.

Step 4. Grow a thin adhesive layer of TiN by a sputtering system. Its thickness is 100 Å. This layer is used to enhance the adhesion between the upper metal layer and the underlying insulating layer, i.e. $Si_3N_4$ in this example.

Step 5. Grow a sacrificial layer to be replaced in the displacement reaction. Ti can be used in this step by sputtering. Its thickness depends on the desired copper. Thicker sacrificial layer will give a thicker copper layer. This selected as 3000 Å in this example.

The wafer (3) manufactured by the above process is put into the EDD solution in which the DI water has been treated previously by the present invention. The copper ions in the chemical solution will be reduced to form copper ad-atoms to displace the Ti atoms. The Ti layer will be gradually replaced by the new copper layer. The reaction will stop after all of the Ti layer is consumed. The sample (3) is then taken out of the plating bath and then cleared by DI water and is dried by a $N_2$ gun.

Figure 3:
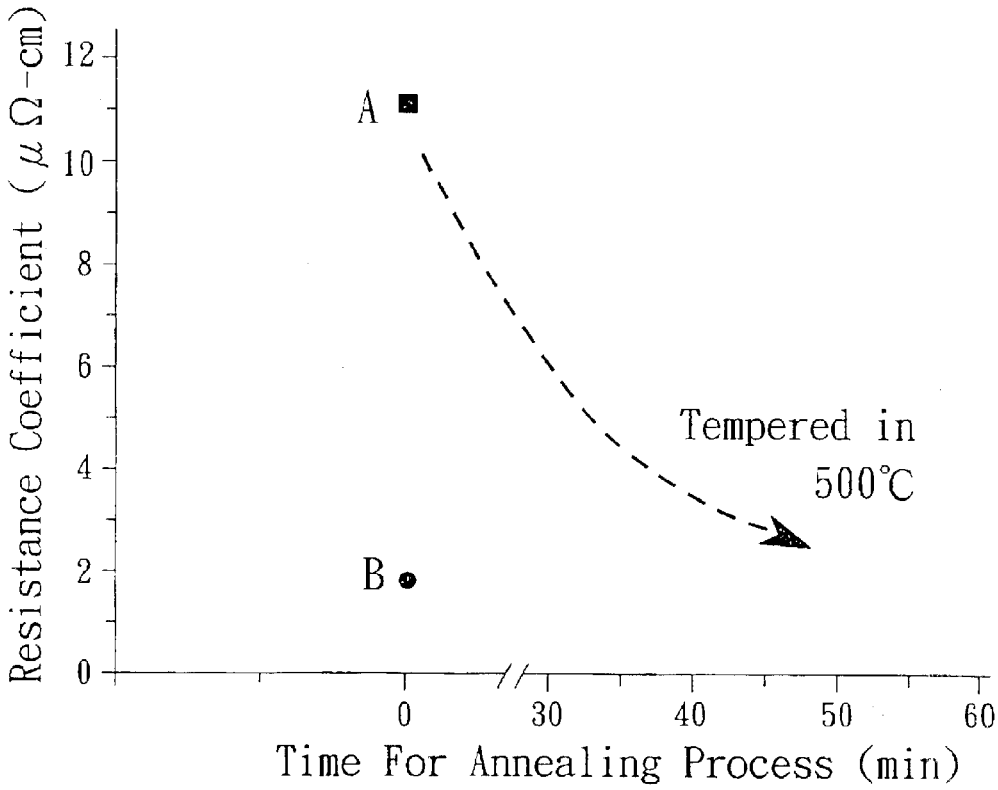
FIG. 3 illustrates the resistivities of two samples, A and B, as-deposited from the EDD solution where sample A was grown in an EDD solution with the oxygen-removing pre-process and sample B was in the solution, without the oxygen-removing pre-process. The resistivity of sample B after a post-annealing process in $H_2$ at 500 degrees centigrade for 50 minutes is also demonstrated for comparison.

In our experiment, it was found that the obtained copper films or wires have a very low electric resistance. FIG. 3 shows the average electric resistance of the copper grown from the EDD solution. In this figure, point B is the resistance of the copper grown from the EDD solution prepared by the method of the present invention. The average value was 1.56 $\mu\Omega$-cm that is very close to the ideal value (1.67 $\mu\Omega$-cm) of bulk copper. Point A indicates the resistance of the copper grown from the EDD solution without the oxygen-removing preprocess. Comparing these two values, the effect of the oxygen-removing preprocess, the current invention, is significant in improving the quality of the chemically grown EDD copper. High-quality EDD copper can be obtained from the solution using the oxygen-removing pre-process, the invention, without a long time of high-temperature post-annealing. Consequently, conventional high-temperature annealing processes can be omitted in improving the quality of the chemical copper.

Although the invention has been explained in a specific EDD reaction, it is believed that this invention may also be applied in many other possible modifications and variations of chemical processes to fabricate copper layers without departing from the spirit and scope of the invention as hereinafter claimed.

What is claimed is:

1. A method for forming copper interconnects including an oxygen-removing pre-process, the method comprising the steps of:

a. providing a solvent;

b. heating the solvent to a boil in an open container and maintaining the boiling condition for a predetermined time period to remove dissolved oxygen therefrom;

c. cooling the solvent while preventing ambient oxygen from being dissolved therein;

d. forming a reaction solution by mixing hydrofluoric acid and cupric sulfate with the cooled solvent;

e. preparing a substrate with a Ti metal displacement layer;

f. immersing the prepared substrate in the reaction solution to carry out a displacement process for forming a copper film layer.

2. The method as claimed in claim 1, wherein the step of maintaining the boiling condition for a predetermined time includes the step of boiling the solvent for two minutes.

3. The method as claimed in claim 2, wherein the step of cooling includes covering the container to prevent ambient oxygen from being dissolved into the solvent during cooling.

4. The method as claimed in claim 3, wherein the step of covering the container includes the step of covering the container with polypropylene film to isolate the solvent from exposure to air.

5. The method as claimed in claim 1, wherein the step of providing a solvent includes the step of providing deionized water.

6. The method as claimed in claim 5, wherein the step of forming a reaction solution includes mixing forty-milliliters of a buffered hydrofluoric acid and four-grams of cupric sulphate mixed in one liter of the deionized water.

7. The method as claimed in claim 3, wherein the step of cooling includes the step of cooling the solvent for forty minutes.

8. The method as claimed in claim 1, wherein the step of forming a Ti metal displacement layer includes forming the Ti metal displacement layer with a sputtering system.

9. The method as claimed in claim 8, wherein the Ti metal displacement layer formed has a thickness of 3000 Å.

* * * * *